US007600712B2

(12) United States Patent
Higham

(10) Patent No.: US 7,600,712 B2
(45) Date of Patent: Oct. 13, 2009

(54) ORNITHOPTER

(76) Inventor: Thomas B. Higham, 140 Oak Neck Rd., Hyannis, MA (US) 02601

( * ) Notice: Subject to any disclaimer, the term of this patent is extended or adjusted under 35 U.S.C. 154(b) by 443 days.

(21) Appl. No.: 11/474,886

(22) Filed: Jun. 26, 2006

(65) Prior Publication Data

US 2007/0295858 A1 Dec. 27, 2007

(51) Int. Cl.
*B64C 33/00* (2006.01)

(52) U.S. Cl. ..... 244/22; 446/35

(58) Field of Classification Search ..... 244/11, 244/22; 446/35

See application file for complete search history.

(56) References Cited

U.S. PATENT DOCUMENTS

| | | | | | |
|---|---|---|---|---|---|
| 1,298,773 | A | * | 4/1919 | James et al. | 244/22 |
| 1,758,178 | A | * | 5/1930 | Slinn | 446/35 |
| 2,182,406 | A | * | 12/1939 | Ogsbury et al. | 446/35 |
| 2,859,553 | A | | 11/1958 | Spencer | |
| 3,728,814 | A | * | 4/1973 | Ruston | 446/35 |
| 3,858,350 | A | | 1/1975 | Lux | |
| 3,912,204 | A | * | 10/1975 | Wheat et al. | 244/154 |
| 4,139,171 | A | * | 2/1979 | Harris | 244/22 |
| 4,155,195 | A | | 5/1979 | Leigh-Hunt | |
| 4,195,438 | A | | 4/1980 | Dale et al. | |
| 4,729,748 | A | | 3/1988 | Van Ruymbeke | |
| 5,176,559 | A | | 1/1993 | Lane | |
| 5,915,650 | A | * | 6/1999 | Petrovich | 244/46 |
| 6,544,092 | B1 | | 4/2003 | Tomas | |
| 6,550,716 | B1 | * | 4/2003 | Kim et al. | 244/11 |
| 6,632,119 | B2 | | 10/2003 | Chernek et al. | |
| 6,659,397 | B1 | * | 12/2003 | Charron | 244/72 |
| 6,802,473 | B2 | * | 10/2004 | Charron | 244/11 |
| 7,255,305 | B2 | * | 8/2007 | Earl et al. | 244/11 |

OTHER PUBLICATIONS

Jones-Bowman, Patricia; "Behemoth Ornithopter Design Notes" Mar. 1, 2004 pp. 1-5.

Ornithopter Zone Store, www.ornithopter.org/store/firebird.info.html Feb. 21, 2006.

* cited by examiner

*Primary Examiner*—Michael R Mansen
*Assistant Examiner*—Joseph W Sanderson
(74) *Attorney, Agent, or Firm*—Wolf, Greenfield & Sacks, P.C.

(57) ABSTRACT

An new ornithopter is provided with an elongated body, wings extending laterally from the forward end of the elongated body, and a tail extending laterally from the rear end of the elongated body. In one embodiment, an elongated rotatable member is rotatably coupled at one end to the forward end of the body, and a mass is connected to the other end of the elongated rotatable member. The elongated rotatable member and the mass are rotated to drive the ornithopter. In another embodiment, a mass is coupled to the forward end of the elongated body, and the mass is moved laterally from one side of the elongated body to the other side of the elongated body to drive the ornithopter. The mass may be imparted with rotational and/or translational movement.

22 Claims, 6 Drawing Sheets

54
56
58
60
61
62
63
67
68
69
70
74
76
78
80
81
82
83
85
87
88
89
90

9
5
3
7
30

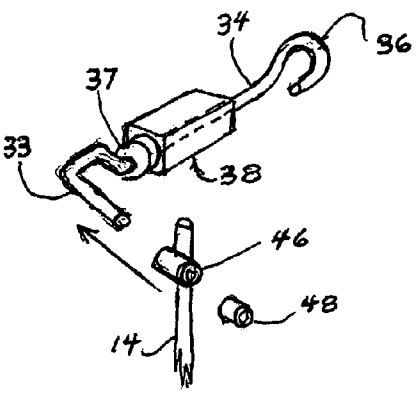
FIG. 8
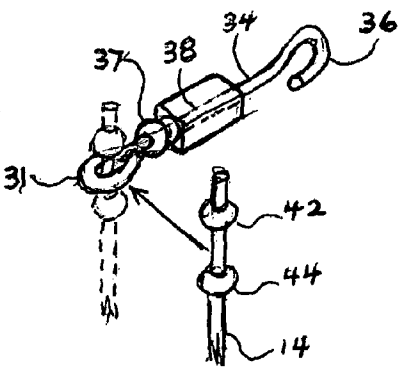
FIG. 9
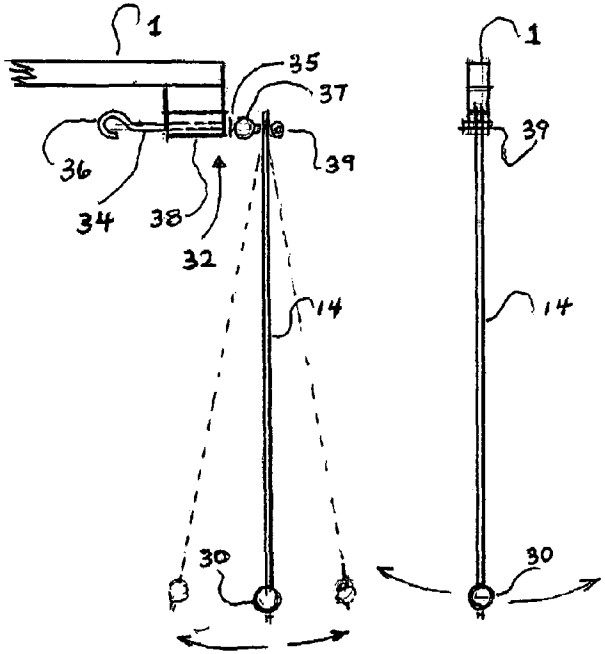
FIG. 7
FIG. 6
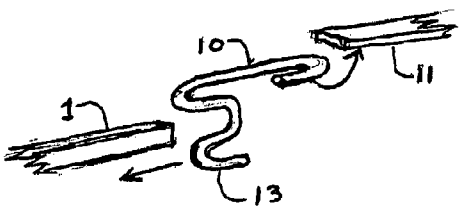
FIG. 10

ORNITHOPTER

FIELD OF INVENTION

The present invention relates to a flying device, more commonly characterized as an ornithopter.

BACKGROUND OF INVENTION

There have been numerous types of ornithopters designed for use as toys. In most of these designs, the ornithopter is shaped similarly to the well-known balsa or paper toy airplanes with a drive mechanism in the form of a rubber-band driven conventional propeller. In general, these devices do not function as a true ornithopter. One deviation from this general design was a development by William Lux, U.S. Pat. No. 3,858,350 which discloses an aerial toy intended to simulate a bird in flight. This aerial toy includes a body with relatively loose wings capable of fluttering within limits during flight, and being propelled by a "single-bladed propeller extending from only one side of the axis of rotation to cause the toy to fly along a sinuous path and induce fluttering of said wings." Lux's device utilizing a single-bladed propeller, however, is deficient since actual test models made of that device appeared not to function in the manner described in that patent. More particularly, the device does not seem to generate forward thrust.

The Lux propeller purports to function as part of a conventional propeller by moving air rearwardly over the wings. Applicant has discovered, however, that the use of this single half-blade propeller is defective and does not provide the necessary forward thrust in combination with wing action desired in the flight of a bird. In fact, in the actual experimentations, little or no flight of this particular device was observed.

One deficiency believed to be present in the Lux device is the use therein of the single half-blade propeller. This propeller functions conventionally as a mover of air. Indeed, Lux describes the propeller blade as "preferably of the nature of a sheet of paper of such stiffness that it is normally self-sustaining." Lux further describes the function of the blade 18. More specifically, it states that "the air resistance to movement of the blade will cause a reaction tending to push the frame and wing downwardly and tending to cause rotation of the frame in a counter-clockwise direction." Lux thereafter describes the presumed interaction of that movement with the interaction of the wing movement to cause flopping or fluttering as the half blade propeller rotates.

Experimentation suggests that the Applicant's invention functions differently and in a superior fashion. Indeed, the Lux device made in accordance with the disclosure at best functions as a bird with a broken wing tumbling to earth without providing a true simulation of bird flight. In this device, the single half-blade propeller tends to react by flipping the wing upside down. The Lux device is accordingly a propeller-driven device in which flutter and whatever movement occurs is a result of reaction between the air resistance to movement of the propeller airfoil and the opposing resistance to air of the wings. The effectiveness in flight of the Lux half propeller is canceled or dampened by the air resistance of the half propeller itself. While it appears that the Lux device will provide a fluttering type of toy, there is no evidence it discloses a device that will move air in a fashion to cause the toy to fly forwardly.

This contrasts with the present invention which is designed to both provide a fluttering appearance and forward movement achieved by using a non air-moving pendulum-like actuating member characterized by a mass at the end of an elongated member and not by a rotatable airfoil in the form of a half propeller.

It is accordingly an objective of the present invention to provide a toy having the ability to simulate the flight of a bird including both flutter and sustained flight over a distance of many feet depending in part upon the amount of propulsion power designed for the particular unit. A further object of the present invention is to provide an ornithopter utilizing a rotatable mass in combination with moveable airfoils as a driving force rather than a propeller-driven system.

The ornithopter is further characterized by an adjustable rudder and tail assembly that may be appropriately adjusted to permit modifications of the movement of the ornithopter in flight.

A further object of the present invention is to provide an improved ornithopter which is inexpensive and easy to manufacture and which can be fabricated and sold at a comparatively low cost.

A further object of the present invention is to provide an ornithopter that can be designed in a variety of shapes to adapt to market conditions in which various bird designs may be employed.

SUMMARY OF INVENTION

The present invention relates to a flying device and primarily to an ornithopter formed of lightweight material and driven, with a propelling source including a rotatable pendulum-like device having a mass secured at one end and pivoted at the other end to the nose or forward end of the ornithopter body. More particularly, the invention is directed to an ornithopter additionally comprising in general an elongated body with wings and a tail extending respectively from the forward and rear ends of the elongated body. An elongated rotatable member has a mass connected to one end of the rotatable member. The pendulum-like device or rotatable member is hinged at a position remote from the end to which the mass is connected to the forward end of the elongated forward end or the nose of the elongated body. Means may be provided for rotating the rotatable member about an axis coincident with the length of the elongated body. In one embodiment, the elongated member is rotated by a length of elastic material such as a rubber band connected at one end to the rotatable member and at the other end to the elongated body at a position remote from the forward end. In one embodiment, the rotatable member is both rotatable about an axis and deflectable in a direction parallel to the axis over a limited arc.

In one aspect of the present invention, an ornithopter is disclosed which includes an elongated body, wings extending laterally from the forward end of the elongated body, and a tail extending laterally from the rear end of the elongated body. An elongated rotatable member is rotatably coupled at one end to the forward end of the body. A mass is connected to the other end of the elongated rotatable member, and means are provided for rotating the elongated rotatable member.

In another aspect of the invention, an ornithopter is disclosed which includes an elongated body, wings extending laterally from the forward end of the elongated body, and a tail extending laterally from the rear end of the elongated body. A mass is coupled to the forward end of the elongated body, and means are provided for moving the mass laterally from one side of the elongated body to the other side of the elongated body.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing.

The foregoing invention and its objectives will be more clearly understood when considered in conjunction with the accompanying drawings in which:

FIG. 6 is a fragmentary elevational view of the elongated rotatable member and associated mechanism used in part for driving the ornithopter;

FIG. 7 is an elevational view of the view of FIG. 6 looking from the front thereof;

FIG. 8 is a fragmentary perspective exploded detail view of components shown in FIGS. 6 and 7 according to one embodiment;

FIG. 9 is an alternate embodiment of the details shown in FIG. 8; and

FIG. 10 is a illustration of a tail attachment according to one embodiment.

DETAILED DESCRIPTION

Figure 1:
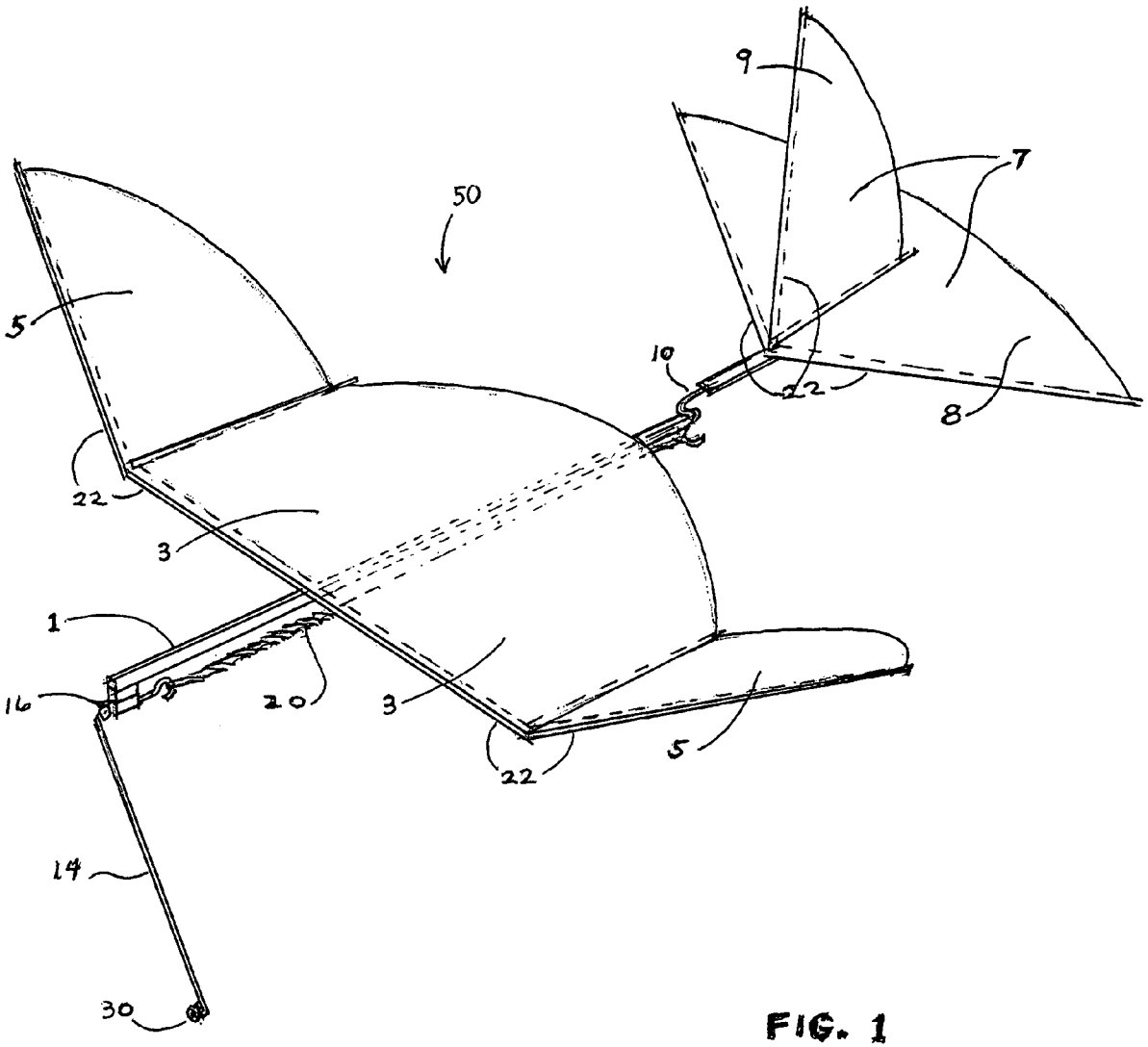
FIG. 1A is a perspective view of an ornithopter according to another embodiment of the present invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The present invention is directed to a new type of ornithopter or flying vehicle. In certain embodiments, the wings of the ornithopter may flutter, having a bird-like flying pattern. As discussed below, the ornithopter may be manually powered, or automatically powered, as the present invention is not limited in this respect. In certain embodiments, the ornithopter may be used as a children's toy. The ornithopter of the present invention may include a fixed wing and tail assembly and the ornithopter may be powered by a movable mass. In some embodiments, the mass may be a rotating eccentric mass, while in other embodiments, the mass may move with translational motion.

A detailed description of several preferred embodiments will further illustrate the scope of the invention herein claimed.

Figure 1A:
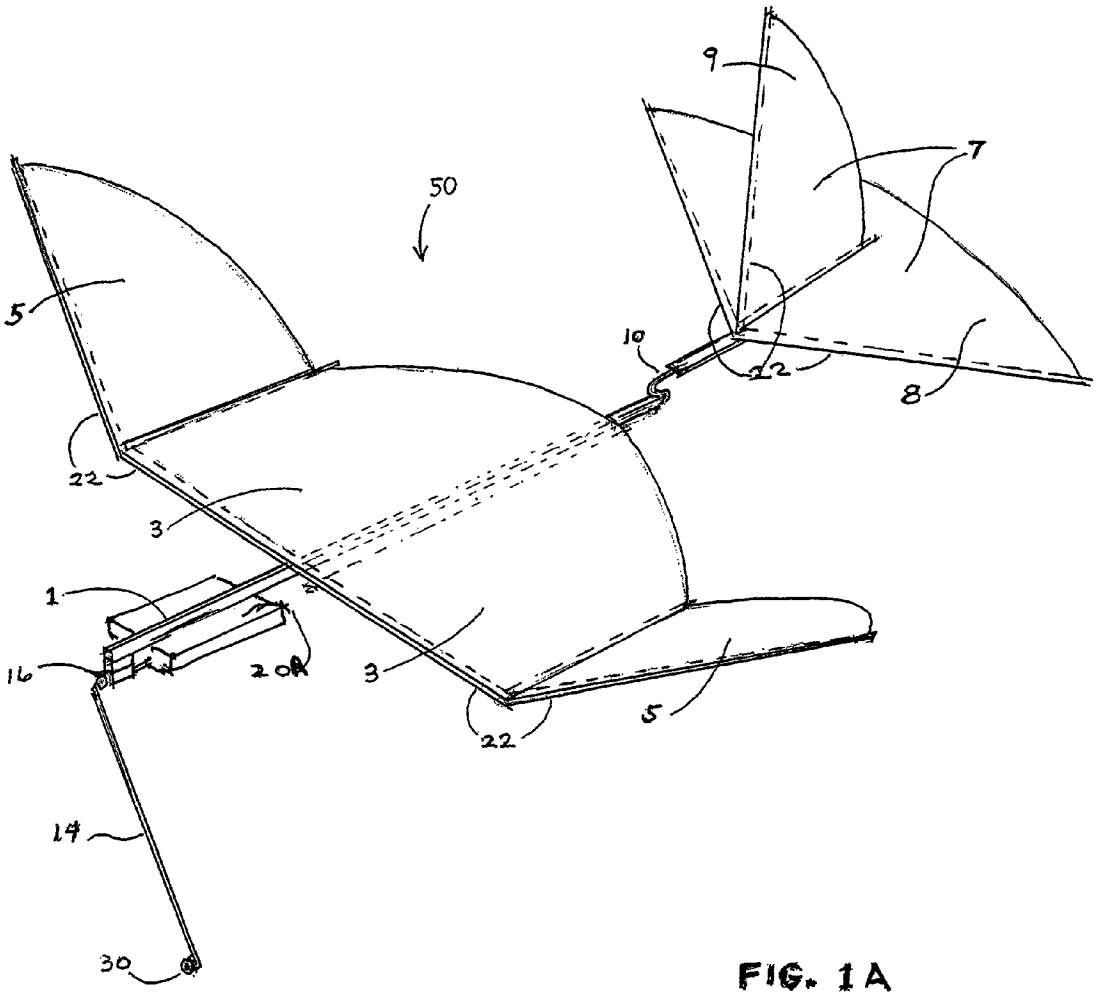

Turning to the figures, as shown in FIG. 1*a*, the ornithopter 50 of the present invention includes an elongated body 1 with forward or main wings 3 extending laterally on either side of the elongated body. As shown in the embodiment of FIG. 1*a*, the wings 3 terminate in dihedrals 5 extending angularly from opposite edges of the wings 3. However, as described below, in some embodiments of the present invention, the wings do not include dihedrals. A tail assembly 7 may include a tail 8 and a rudder 9 with the rudder extending angularly from and symmetrical with respect to the tail 8. The tail assembly 7 may be adjustably secured by attachment 10 to the rear end of the elongated body 1. In one embodiment, at least one of the wings 3, the tail 8 and the rudder 9 are formed of a flexible membrane. As discussed below, in one embodiment, the wings 3, tail 8 and rudder 9 are each formed of a flexible membrane.

As shown in the embodiment of FIG. 1*a*, an elongated rotatable member 14 is rotatably secured to the forward end of the elongated body 1. The elongated member 14 is coupled to the elongated body 1 by a means 16 for rotatably supporting and securing one end of the elongated member 14 in a manner hereinafter described. A mass 30 is connected to one end of the elongated member 14 for rotation therewith. In one embodiment, the rotating means 16 includes a rubber motor or equivalent drive mechanism 20 to provide rotational power to the elongated member 14 as hereafter described.

In one embodiment, the drive mechanism 20 may simply be a rubber band. The rubber band may be secured at one end to the hinged end of the elongated member and secured at the other end to a remote portion of the elongated body 1. To store energy in the drive mechanism, the elongated member 14 and mass 30 may be manually rotated in one direction, for example, either clockwise or counterclockwise, to twist or coil the rubber band. When released, the elongated member 14 and mass 30 spin in response to the stored energy in the twisted rubber band as it uncoils. As discussed in greater detail below, non-manual embodiments are also contemplated.

Figure 2C:
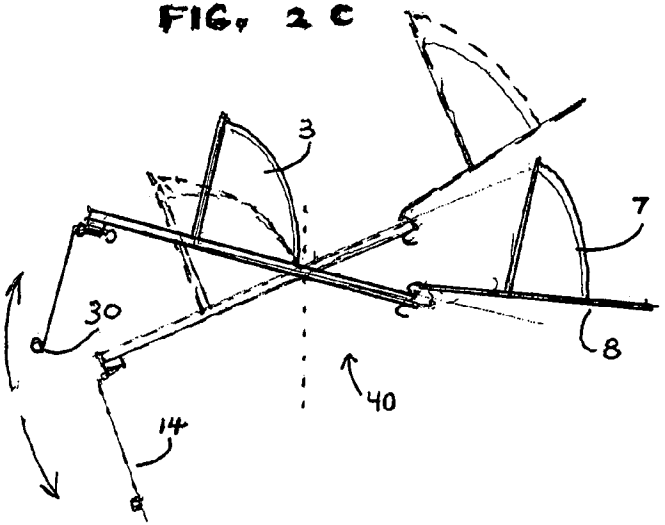
FIGS. 2A-2D are illustrations which depict the flight of an ornithopter according to one embodiment.
Figure 2D:
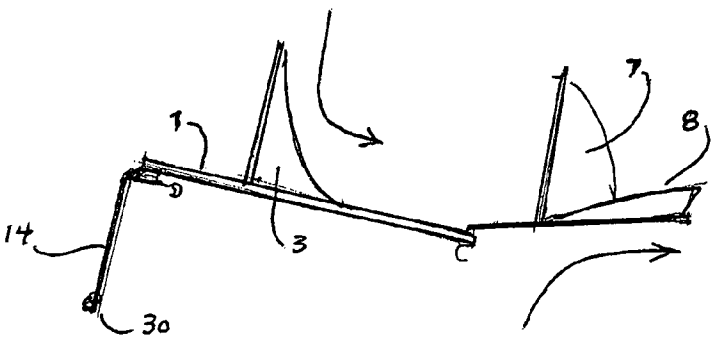
Figure 2A:
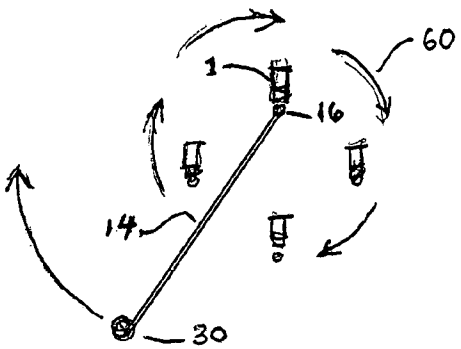
Figure 2B:
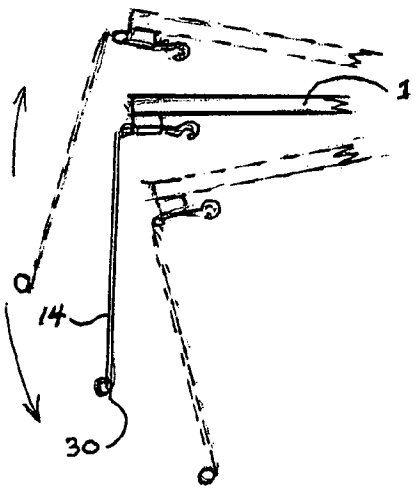

As the elongated member 14 rotates, the mass 30 spins around which powers the ornithopter. FIGS. 2A-2D illustrate conceptually how this movement powers an ornithopter to fly. As shown in FIG. 2A, as the mass 30 rotates, it imparts an eccentric motion to the elongated body 1. FIG. 2A depicts a front view of the ornithopter and shows the path 60 of the axis of rotation during this movement of the elongated member 14 and mass 30. Similarly, FIG. 2B illustrates a partial side view of the ornithopter during the movement of the elongated member 14 and mass 30. As shown, the forward end of the elongated body 1 extends up and down as the position of the mass 30 changes. As shown in FIG. 2C, this creates an axis of oscillation between the main winged body portion 40 and the tail assembly 7. As the wing 3 go up, the flexible membrane which forms the wing 3 flexes downwardly. As shown in FIG. 2D, this downward motion of the wing membrane directs the airflow backwards towards the tail assembly 7. At the same time, the tail membrane flexes upwardly which drives the ornithopter forward in a flying-like pattern. Whilst compound movements are the components shown, they include both movement of the mass in a rotational direction as well as in a translational movement. In short, the mass movement both rotates and moves forward as the ornithopter is flown.

Figures 3, 4:
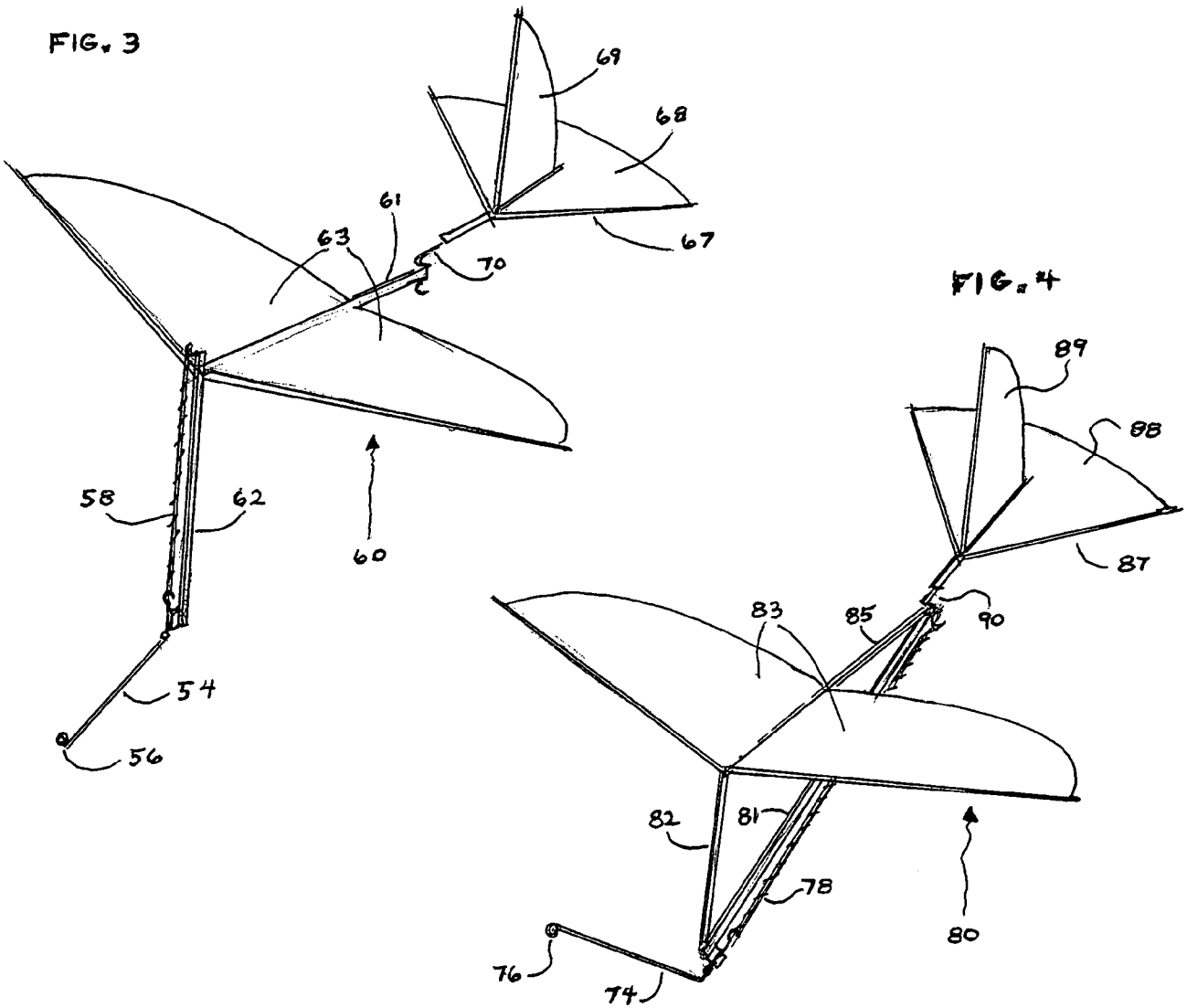
FIG. 3 is an illustration of an alternate embodiment.
FIG. 4 is a perspective view of a still further alternate embodiment.

FIGS. 3 and 4 illustrate additional embodiments of an ornithopter according to the present invention. The ornithopter 60 in FIG. 3 includes an elongated body 61, wings 63 extending laterally on either side of the elongated body 61, and a tail assembly 67. The tail assembly 67 may include both a tail 68 and a rudder 69, where the tail assembly 67 is adjustably secured to the rear end of the elongated body 61 by attachment 70. Similar to the embodiment of FIG. 1*a*, this ornithopter 60 also includes an elongated rotatable member 54 and a mass 56. However, in contrast to the embodiment illustrated in FIG. 1*a* , the rotatable member 54 and mass 56 are rotatable about a different axis of rotation. In particular, as shown in the embodiment of FIG. 3, the elongated body 61, 62 is either bent or made of two components such that a portion of the elongated body hangs downwardly at the forward end of the ornithopter. As shown in FIG. 3, a drive mechanism 58 extends along this downwardly extending section of the elongated body 62. As discussed above, the drive mechanism 58 is operatively engaged to provide rotational power to the elongated member 54 and mass 56. Due to the orientation of the elongated body 61 and the drive mechanism 20, the mass 56 rotates about a different axis than the mass 30 in FIG. 1*a* . However, in both embodiments, the mass 30, 56 is moved laterally from one side of the elongated body to the other side to impart an eccentric motion to the ornithopter.

FIG. 4 illustrates yet another embodiment of the present invention. In some respects, the ornithopter 80 in FIG. 4 is configured to be a combination of the embodiments illustrated in FIGS. 1*a* and 3. As shown in FIG. 4, the elongated body is arranged to have three components 81, 82, 85 which as shown in the figure, form a triangular-shaped configuration. The wings 83 attach to the top component 85 of the elongated body, and the lower angled component 81 of the elongated body includes the drive mechanism 78. The third component 82 connects these two components together, coupling the wings 83 to the elongated member 74 and mass 76. In this embodiment, the elongated member 74 and mass 76 rotate about a different axis than the embodiments shown in FIGS. 1*a* and 3. In FIG. 4, the elongated member 74 and mass 76 rotate about the downwardly extending axis of the lower angled component 81 of the elongated body. As shown in FIG. 4, this ornithopter 80 has a tail assembly 87 including a tail 88 and a rudder 89 which connect to the elongated body wing section at attachment 90. The attachment 90 may be bendable, flexible and/or movable to adjust the direction of the tail assembly 87 with respect to the other portions of the ornithopter, as described in greater detail below.

Each of the embodiments illustrated in FIGS. 1*a* , 3 and 4, include many of the same or similar components. One primary difference between each of these embodiments is the position and orientation of the elongated member and associated mass which rotates about a portion of the ornithopter. In each configuration, the elongated member and mass rotate about an axis which is parallel with the axis of the portion of the elongated body which includes the drive mechanism. In FIG. 1*a* , the drive mechanism 20 is parallel with the main axis of the ornithopter. In contrast, in FIG. 3, the drive mechanism is perpendicular to the main axis of the ornithopter, and in FIG. 4, the drive mechanism is angled, positioned along an axis which is approximately 45 degrees offset from the main axis of the ornithopter. However, in all three embodiments, the mass 30, 56, 76 is moved laterally from one side of the elongated body to the other side to impart an eccentric motion to the ornithopter.

It should be appreciated that the mass 30, 56, 76 moves to impart motion to the ornithopter without substantial air displacement. This is in contrast to an airfoil or propeller. In some embodiments of the present invention the mass is a substantially non-air moving pendulum-like actuating member.

As shown in FIGS. 1*a* , 3 and 4, the size and shape of the wings and tails may vary as the present invention is not limited in this respect. The ornithopter may also be made of various materials. It is desirable that the ornithopter be constructed out of lightweight materials so that the ornithopter can fly through the air. In one embodiment, the elongated body may be made of a balsa wood. It should be appreciated that in other embodiments, the body may be made from other materials such as plastic and other types of wood. To reduce the weight of the body, it may be desirable to use hollow components. Similarly, the wings, tail and rudder may also be constructed from light weight materials. For example, a thin flexible membrane may be used from materials such as woven fabric, mylar, paper tissue, or other thin plastic sheeting. In one embodiment, the wings, tail and rudder may include spars 22 (see FIG. 1*a* ) which define the leading edge of the wings, tail and rudder. The spars 22 may be secured to the elongated body to secure the flexible membranes to the body. The spars may be constructed from a material similar to the elongated body. For example, in one embodiment, the spars are made from balsa. As shown in FIG. 1*a* , in one embodiment, the edges of at least one of the wings, tail and rudder other than the leading edge are unrestrained and flexible in response to forces of air. In other embodiments, portions of the flexible membranes may be secured directly to the body.

Figures 5A, 5B, 5C:
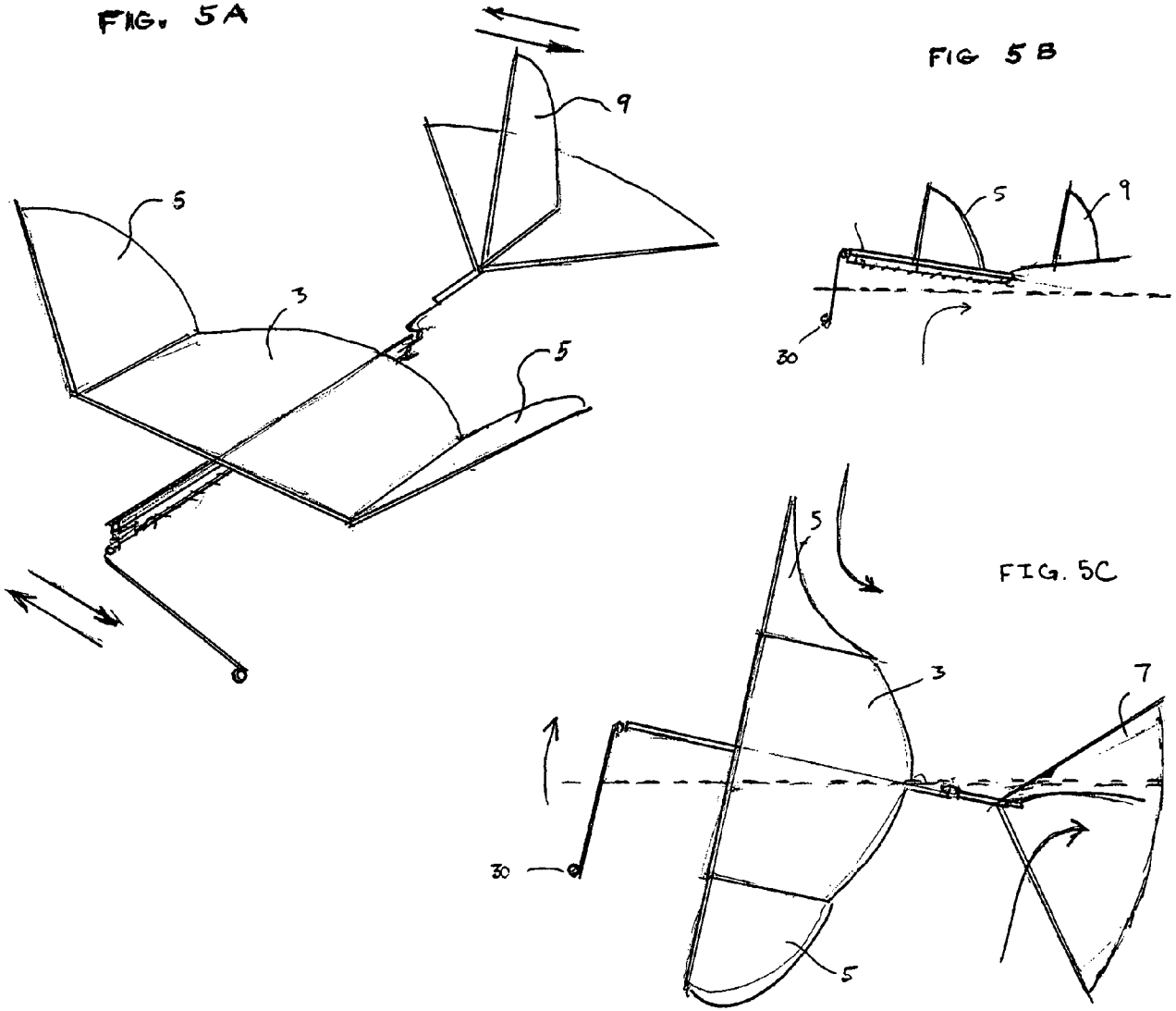
FIGS. 5A-5C are illustrations which depict the interaction between the dihedrals and the rudder according to one embodiment.

As shown in the embodiment of FIG. 1*a* , the wings 3 may include dihedrals 5. In this particular embodiment, the angle between the main portion of the wing 3 and the dihedrals is fixed at approximately 45 degrees. However, it should be appreciated that this angle could vary. The flight of the ornithopter may be optimized through these dihedrals 5. For example, as shown in the perspective view of an ornithopter of FIG. 5A, the side view of FIG. 5B, and the top view of FIG. 5C, as the mass moves in the horizontal axis, the dihedrals 5 work with the rudder 9 to produce forward thrust. This side to side movement is similar to the up/down reaction between the main wings 3 and the tail 8 in a vertical axis. Lift is then created by the differing angles of incidence between the wing and the tail.

Turning now to FIGS. 6-7, the coupling of the elongated member 14 to the drive mechanism 20 and elongated body 1 is further described and illustrated. FIG. 6 illustrated a side view of this coupling and FIG. 7 illustrates a front view according to one embodiment of the present invention. In one embodiment, FIGS. 6 and 7 correspond to the ornithopter shown in FIG. 1*a* . In the embodiment of FIGS. 6 and 7, a hinge mechanism 32 is provided with a rotatable shaft 34 with one end of the shaft 34 secured to the means 16, such as a rubber band (not shown) for rotating the elongated member. In FIG. 6, one end of the shaft 34 has a hook 36 which may be used to secure the drive mechanism 20, whether it is a manual drive mechanism, such as a rubber band, or a more automated mechanism. As the drive mechanism uncoils the shaft 34 rotates which in turn rotates the elongated member 14 and mass 30. A support block 38 may be secured to the elongated body 1 to form a journal or bearing for the shaft 34, with the shaft 34 extending through the block 38. The elongated member 14 is coupled to the shaft 34 at the other end of the shaft 34, opposite the hook 36. In the embodiment shown in FIGS. 6 and 7, an opening provided with the elongated member 14 is threaded onto the shaft and the elongated member 14 is positioned on the shaft 34 between a spherical bead 37 and an end cap 39. However, it should be appreciated, that in other embodiments, the elongated member 14 may be coupled to the elongated body 1 differently. A washer 35 may also be provided between the block 38 and the distal end of the shaft 34.

In addition to the rotation of the elongated member 14 and mass 30 about the axis of the shaft 34 and/or elongated body 1 (as shown in FIG. 7), there may also be movement of the elongated member 14 and mass 30 in a limited arc in a direction parallel to the elongated body as the ornithopter is in flight (as shown in FIG. 6). This arc-like movement may assist to further drive the ornithopter. For example, in one embodiment, the elongated member 14 and mass 30 are capable of swinging in an arc of approximately 30-40 degrees. This movement may be adjusted by altering the spacing of the elongated member 14 on the shaft 34. Moving the position of the washer 35, spherical bead 37 and/or end cap 39 may affect the size of the arc movement of the elongated member 14.

FIGS. 8 and 9 illustrate more detailed views of some of the embodiments for rotating the elongated member 14. The embodiment illustrated in FIG. 8 similarly shows a shaft 34 with hook 36 at one end, and a support block 38 to couple the shaft to the elongated body 1. At the other end of the shaft 34, a C-shaped hook 33 is provided. It should be appreciated that in other embodiments, other shapes may be contemplated as the present invention is not so limited. A tube-like pivot point attachment 46 is coupled to the elongated member 14 and forms an opening which is slidably inserted onto the hook 33 on the shaft to couple the elongated member 14 to the shaft 34. A retainer 48 may be positioned on the end of the hook 33 to prevent the elongated member 14 from sliding off the shaft 34. A spherical bead 37 may also be provided adjacent the C-shaped hook 33. Due to the size and shape of the distal end, arc-like swinging movement of the elongated member 14 and mass 30 may occur during the rotation of the elongated member 14 to further drive the ornithopter.

In FIG. 9, a shaft 34 with a hook 36 at one end of the shaft 34 for securing the drive mechanism 20 is provided with a similar support block 38 to couple the shaft to the elongated body 1. However, at the other end of the shaft 34, a loop 31 is provided. As shown, two protrusions or beads 42, 44 on the elongated member 14 align and couple the elongated member 14 to the loop 31 of the shaft 34. Due to the size and shape of the loop 31 with respect to the elongated member 14 and protrusions, the above described arc movement of the elongated member 14 and mass 30 may also be achieved. As shown in FIG. 9, a spherical bead 37 may also be provided adjacent the loop 31 on the shaft 34.

The embodiments illustrated in FIGS. 6-9 illustrate various distal end configurations for coupling the elongated member 14 to both the drive mechanism 20 and the body 1 of the ornithopter. As mentioned above, the elongated body 1 may be made of a lightweight material, such as balsa. In one embodiment, the elongated member 14 is made of carbon fiber rod. In other embodiments, the elongated member 14 may be constructed of other materials such as music wire, or plastic. In some embodiments, the elongated member 14 is rigid, yet in some embodiments, the elongated member may be made of a more flexible, less rigid material, as the present invention is not limited in this respect. In one embodiment, the mass 30 is made of a material similar to the elongated member 14. Furthermore, it is also contemplated that the mass may be formed by coiling or rolling up a portion of the elongated member. However, it is also contemplated that the mass is made from metal or other concentrated weight. In one embodiment, the mass 30 weighs approximately 0.25 grams. In one embodiment, the mass 30 weighs approximately between about 10% and about 15% of the overall weight of the ornithopter 50.

Although the above embodiments illustrate a shaft 34 that is coupled to the elongated member 14, it is also contemplated that the shaft 34 may bend downwardly to form an integral piece with the elongated member 14. In this embodiment, a flexible material, such as piano wire, may be a preferred material for constructing the elongated member 14. However, in this embodiment, there may be less arc movement (see FIG. 7). There may be some movement due to the flexibility of the material, but it may be movement due to flexing, rather than swinging of the elongated member 14. In certain embodiments, the swinging movement may be preferable to further drive the ornithopter.

As mentioned above, in certain embodiments, the mass on the elongated member may behave similar to a pendulum. In certain embodiments, the combination of the elongated member and the mass may be defined as a "rotater" or a "rotater mechanism". In one embodiment, the center of gravity of the ornithopter may be altered to optimize flight. For example, the length of the elongated member 14 may be adjustable. When the elongated member 14 is shortened, such as for instance by coiling or wrapping a portion of the member 14 onto the mass 30, the center of gravity changes.

As mentioned above, the attachment element 10 which connects the tail assembly to the wings may be adjustable, and may for example be bendable or flexible. The attachment element 10 may be adjusted to optimize flight of the ornithopter. One type of tail attachment element 10 is illustrated in FIG. 10. As shown, the tail attachment 10 is made of a curved hook-like component, which may for example be constructed from steel wire. The back portion of the tail attachment 10 may be coupled to the tail boom 11. Although it may be coupled in a variety of ways, in one embodiment, the tail attachment is glued to the bottom of the tail boom and it is wrapped with reinforcing thread (not shown). The front portion of the tail attachment 10 may be slid onto the rear portion of the elongated body 1 as shown by the arrow. Reinforcing thread (not shown) may also be wrapped around this connection of the tail attachment 10 to the elongated body 1. As shown in FIG. 10, the tail attachment 10 may also include a hook portion 13 to attach the remote end of the rubber band or other type of drive mechanism 20.

As mentioned above, the ornithopter may be manually powered, such as for example with the use of a rubber band motor. However, it is also contemplated that an automated system may be used as well. For example, in one embodiment, an electric motor 20A is used to power the movement of the elongated member and mass.

Furthermore, although the above-mentioned embodiments illustrate rotational movement of the elongated member and mass, it is also contemplated that the ornithopter of the present invention include a mass having translational movement from side to side of the ornithopter.

The ornithopter according to the present invention may be shaped and configured in a variety of ways. In certain embodiments, the overall length of the ornithopter may be roughly equal to the total wingspan of the ornithopter. Furthermore, in certain embodiments, the length of the elongated body is approximately 60% of the overall total length of the ornithopter. The area of the tail may be approximately 30% of the area of the wings. Additionally, the area of the rudder may be approximately 50% of the area of the tail. In one embodiment utilizing a rubber band for the drive mechanism, the weight of the rubber band is approximately 30% of the total weight of the ornithopter. As mentioned above, the weight of the mass may be approximately 10-15% of the total weight of the ornithopter. The length of the elongated member may be approximately 33% of the total wingspan, and the angle tip of the dihedrals may vary from approximately 30-45% from the main portion of the wing.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An ornithopter comprising:

an elongated body;

fixed wings extending laterally from the forward end of the elongated body;

a tail extending laterally from the rear end of the elongated body and means adjustably connecting the tail to the elongated body;

an elongated rotatable member rotatably coupled at one end to the forward end of the body;

a mass connected to the other end of the elongated rotatable member; and means for rotating the elongated rotatable member without substantial air displacement.

2. An ornithopter as set forth in claim 1, further comprising:

a rudder extending angularly from the tail, and wherein at least one of the wings, the tail and the rudder are formed of a flexible membrane.

3. An ornithopter as set forth in claim 2, wherein the wings are symmetrically secured on either side of the elongated body, and the wings are formed of a flexible membrane.

4. An ornithopter as set forth in claim 2, wherein the wings, tail and rudder are each formed of a flexible membrane.

5. An ornithopter as set forth in claim 4, wherein spars secured to the elongated body define the leading edges of the wing, tail and rudder.

6. An ornithopter as set forth in claim 5, wherein edges other than the leading edges of the wing, tail and rudder are unrestrained and flexible in response to forces of air.

7. An ornithopter as set forth in claim 6, wherein the means for rotating the elongated rotatable member includes a twistable elongated rubber band secured at one end to the one end of the elongated rotatable member and secured at the other end to the elongated body at a position remote from the one end of the elongated body.

8. An ornithopter as set forth in claim 7, wherein rotation in one direction of the hinged elongated member twists the rubber band with a coiled length and release of the elongated member allows it to spin in response to stored energy with twisted rubber band as it uncoils.

9. An ornithopter as set forth in claim 1, having a hinge mechanism secured to the one end of the elongated body and supporting the elongated member for rotation.

10. An ornithopter of claim 9, with the hinge mechanism having a rotatable shaft with one end shaped to secure an end of the means for rotating the elongated member and the other end supporting the elongated member for rotation about the axis of said shaft and with the rotatable member moveable in a limited arc in a direction parallel to the elongated body as the ornithopter is in flight.

11. An ornithopter as set forth in claim 9, having a supporting block secured to the elongated body and forming a journal for the shaft with the shaft extending through the block and with a spherical bead on the shaft intermediate the block and elongated member.

12. An ornithopter as set forth in claim 1, wherein the mass has a weight in the order of magnitude of approximately between 10% to 15% of the overall weight of the ornithopter.

13. An ornithopter as set forth in claim 1, further comprising:

an attachment coupling the tail to the elongated body.

14. An ornithopter as set forth in claim 13, wherein the attachment is flexible to allow for directional adjustment.

15. An ornithopter as set forth in claim 1, wherein the elongated member is rigid.

16. An ornithopter as set forth in claim 1, wherein the wings include dihedrals on each side of the elongated body.

17. An ornithopter comprising:

an elongated body;

fixed wings extending laterally from the forward end of the elongated body;

a tail connected to and extending laterally from the rear end of and moveable in relation to the elongated body;

a mass coupled to the forward end of the elongated body;

means for moving the mass laterally from one side of the elongated body to the other side of the elongated body without substantial air displacement.

18. An ornithopter as set forth in claim 17, wherein the means for moving the mass imparts rotational movement in the mass.

19. An ornithopter as set forth in claim 18, wherein the means for moving the mass includes an elongated rotatable member coupled to the forward end of the elongated body, wherein the mass is coupled to the elongated member.

20. An ornithopter as set forth in claim 19, wherein the means for moving the mass includes a twistable elongated rubber band secured at one end to the elongated rotatable member and secured at the other end to the elongated body.

21. An ornithopter as set forth in claim 17, wherein the means for moving the mass imparts translational movement in the mass.

22. An ornithopter as set forth in claim 17, wherein the means for moving the mass includes an electric motor.

* * * * *